United States Patent [19]

Ledgerwood

[11] Patent Number: 4,493,447

[45] Date of Patent: Jan. 15, 1985

[54] HIGH SPEED ARTICLE FEEDING APPARATUS

[75] Inventor: Harry J. Ledgerwood, Conway, Mo.

[73] Assignee: Plessey Incorporated, Melville, N.Y.

[21] Appl. No.: 493,608

[22] Filed: May 11, 1983

[51] Int. Cl.[3] ..... B65H 17/44; B65H 17/36; B65H 17/36

[52] U.S. Cl. ..... 226/150; 226/159; 226/162

[58] Field of Search ..... 226/150, 163, 162, 158, 226/149, 165; 308/5 R

[56] References Cited

U.S. PATENT DOCUMENTS

| | | | |
|---|---|---|---|
| 3,123,270 | 3/1964 | Olson | 226/162 |
| 3,157,334 | 11/1964 | Bunnell | 226/162 X |
| 3,429,493 | 2/1969 | Lehmann | 226/150 |
| 3,485,430 | 12/1969 | Scribner | 226/150 X |
| 3,512,438 | 5/1970 | Burdge | 226/162 |
| 3,523,632 | 8/1970 | Shields | 226/150 |
| 3,735,907 | 5/1973 | Kuchar | 226/150 |
| 3,902,768 | 9/1975 | Neumann | 308/5 R |
| 3,937,379 | 2/1976 | Narwid | 226/150 |
| 4,059,212 | 11/1977 | Ledgerwood | 226/162 X |
| 4,312,469 | 1/1982 | Nilsson | 226/150 |

*Primary Examiner*—John M. Jillions
*Assistant Examiner*—Leo J. Peters
*Attorney, Agent, or Firm*—Fleit, Jacobson, Cohn & Price

[57] ABSTRACT

A high speed article feeding apparatus for successively feeding articles in sheet or strip form to a work station for the performance thereon of a shaping or forming operation. A reciprocable shuttle includes a pneumatic feed clamp for clamping the work during a feed stroke and a pneumatic hold clamp for holding the work at the work station. The shuttle is operated by a pneumatic cylinder. A pneumatic circuit includes two interconnected pneumatic values to control the operation and sequencing of the elements of the feeder for fast operation without misfeeds.

10 Claims, 14 Drawing Figures

FIG. 5
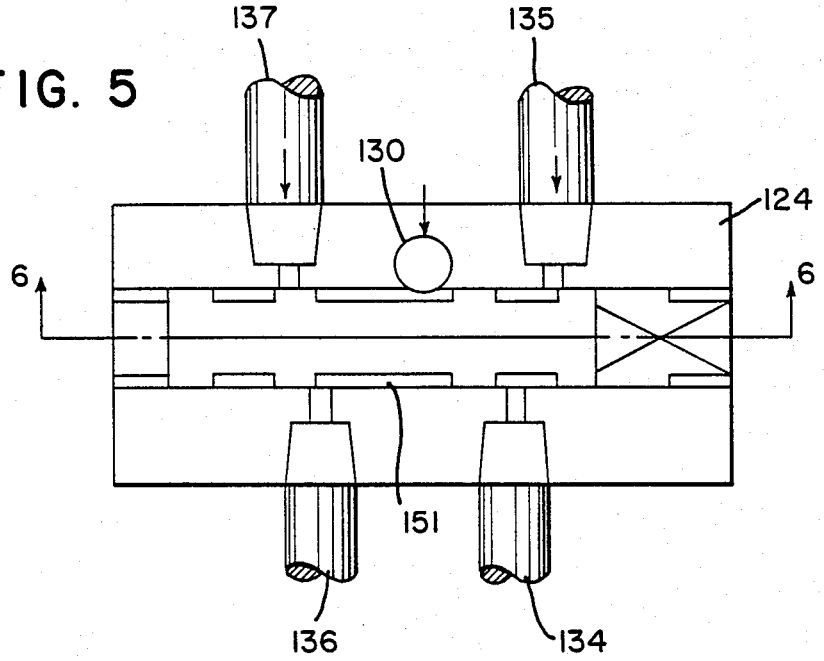
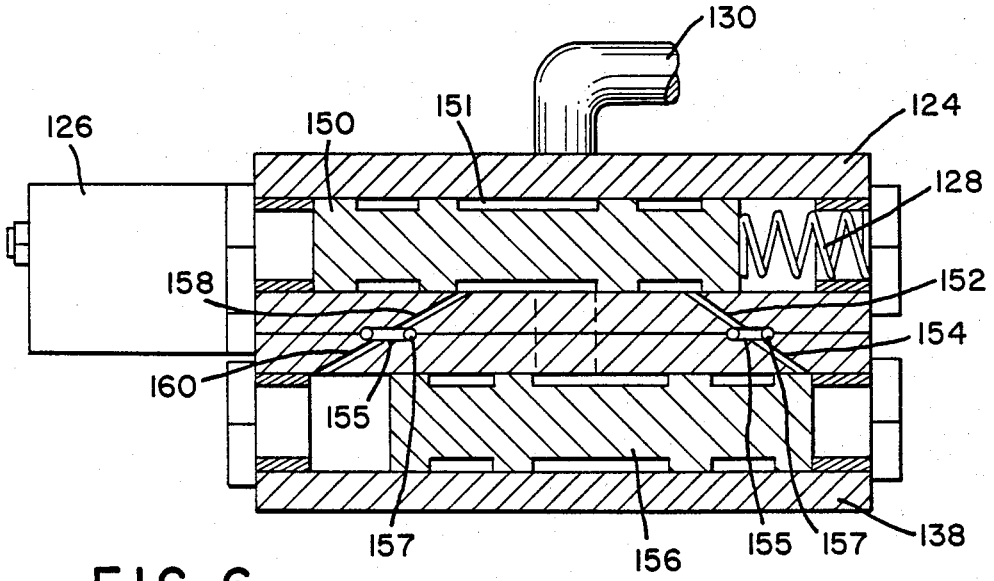
FIG. 6

FIG. 7
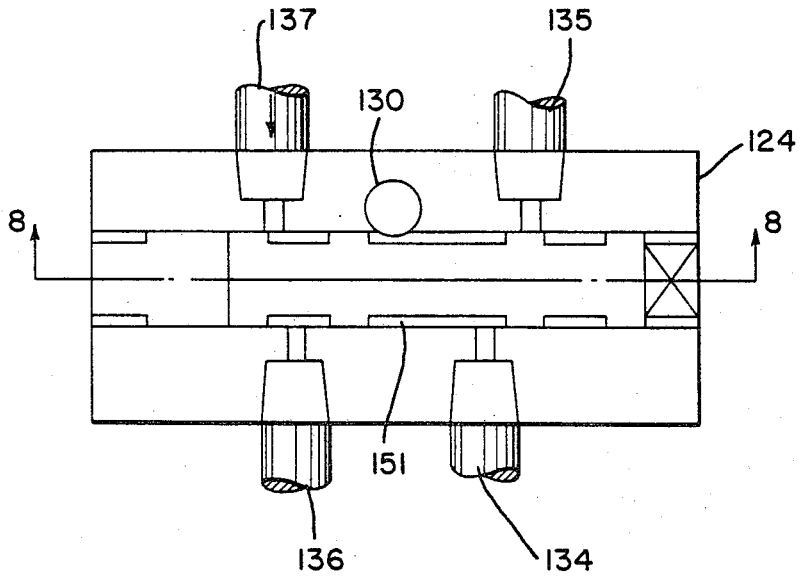
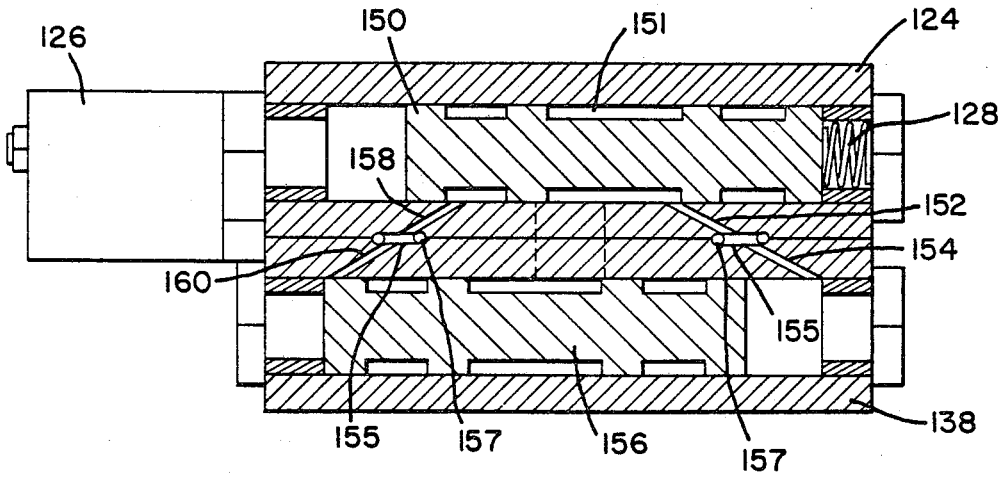
FIG. 8

HIGH SPEED ARTICLE FEEDING APPARATUS

BACKGROUND OF THE INVENTION

1. Field of the Invention

This invention relates to apparatus for successively feeding articles to a work station, and more particularly to a high speed article feeding apparatus incorporating an automatic sequencing circuit for controlling the operation of the several elements thereof.

2. Description of the Prior Art

There are various types of known apparatus for successively feeding articles from a feed position to a work station where one or more operations are performed thereon, and which is thereafter conveyed from the work station and another article is brought thereto. Although generally satisfactory for the intended purpose, the prior art feed devices are limited in the speed at which they can operate and sometimes involve misfeeds of articles, which can cause excessive down time of the apparatus.

In feed systems wherein the work pieces are gripped, conveyed to the work station, released from the conveying means, gripped by a holding means during the performance of the particular operation thereon and then released, the sequence of events must follow a predetermined order or a misfeed can occur. For example, in the apparatus illustrated and described in U.S. Pat. No. 4,059,212, which issued on Nov. 22, 1977, and which is owned by the assignee of the present invention, a stock feeder for punched stock is disclosed which utilizes a pneumatic circuit for actuating the several gripping and transporting means provided. That system relies on utilizing fluid passageways of differing cross-sectional areas in order to control the sequencing of the several operations. There are times, however, when a misfeed can occur to cause the operation to be temporarily halted while the misfeed situation is corrected. Additionally, the system therein disclosed operates using a plurality of limit switches to control the operation of the pneumatic circuit and the larger number of parts unnecessarily encumber the system and each are subject to malfunction or failure, thereby diminishing the reliability of the system.

It is therefore desirable to provide a system which overcomes the shortcomings in the prior art devices.

SUMMARY OF THE INVENTION

It is an object of the present invention to provide an article feed system which is capable of operating at high speeds.

It is another object of the present invention to provide an article feed system wherein the various sequencing steps during the feeding operation are positively controlled.

It is a further object of the invention to provide an article feed system which incorporates fewer parts for improved reliability.

It is still a further object of the present invention to provide a feed system wherein frictional and inertia loads on the feeding apparatus are minimized.

Briefly stated, in accordance with one aspect of the present invention, a feed apparatus is provided for successively feeding articles to a work station. The apparatus includes means for gripping the articles, means for conveying the articles to the work station, and means for holding the articles while they are at the work station and an operation is performed thereon. The operations are controlled by a fluid circuit which operates the several elements of the apparatus in a predetermined sequence. The fluid circuit includes a first control valve for actuating work holders in a predetermined sequence, and a feed control valve which is operatively associated with the clamp control valve so that operation of the feed device is correlated with the positions of the several clamping devices.

FIGS. *3a–3e* are a series of schematic views of the inventive fluid sequencing circuit for controlling the several elements of the feeder of the present invention and show the arrangement of the control valves during various stages of the operating cycle.

Figure 2:
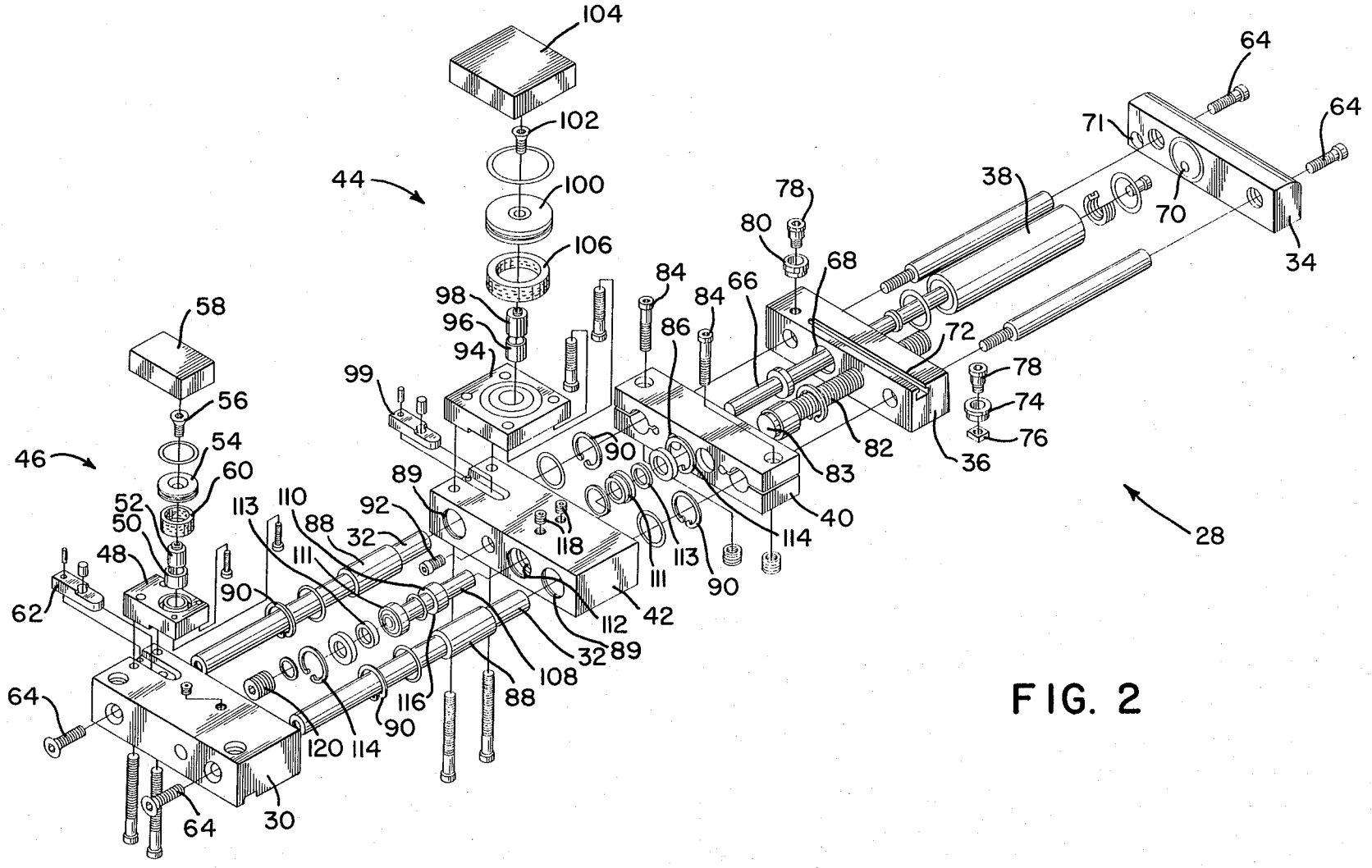
FIG. 2 is an exploded perspective view of the feed apparatus shown in FIG. 1.
Figure 4:
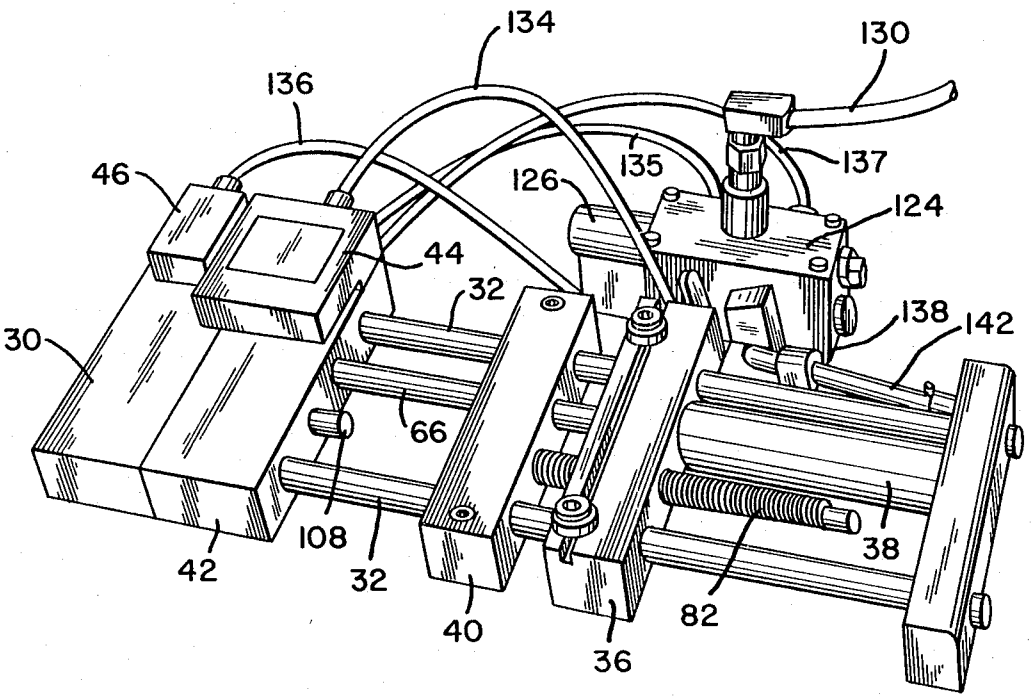

FIG. 4 is a top perspective view of the feed apparatus of FIG. 2 shown in assembled form.

FIG. 5 is a top cross-sectional view taken of the control valve when the solenoid is deenergized.

FIG. 6 is a side cross-sectional view of the adjacent control valves when the solenoid is deenergized.

FIG. 7 is a top cross-sectional view similar to FIG. 5 but showing the control valve after the solenoid has been energized.

FIG. 8 is a side cross-sectional view similar to FIG. 6 when the solenoid is energized.

Figure 9:
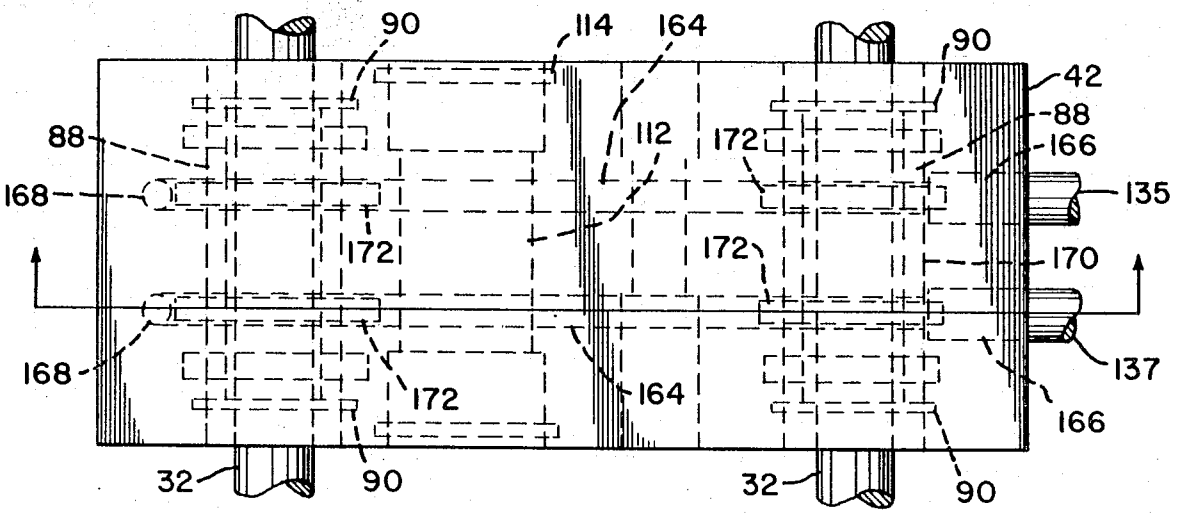

FIG. 9 is a top view of the feed block used to support and feed the work.

Figure 10:
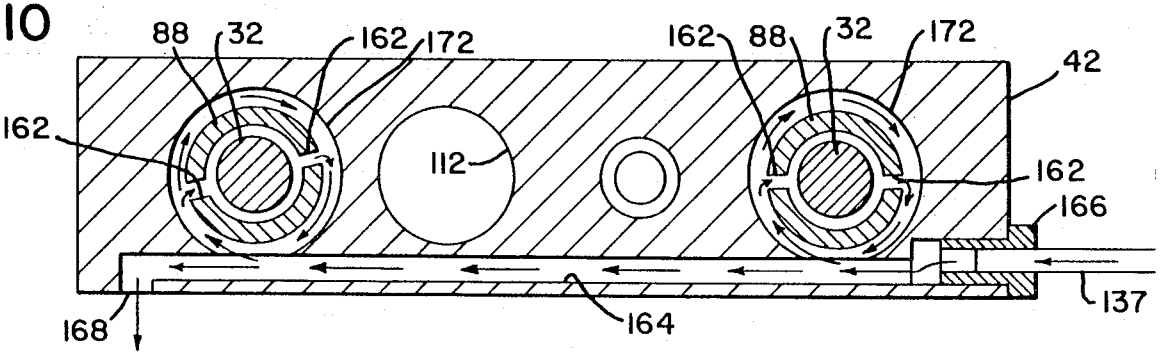

FIG. 10 is a cross-sectional view taken along the line 10—10 of FIG. 9.

DESCRIPTION OF THE PREFERRED EMBODIMENT

Figure 1:
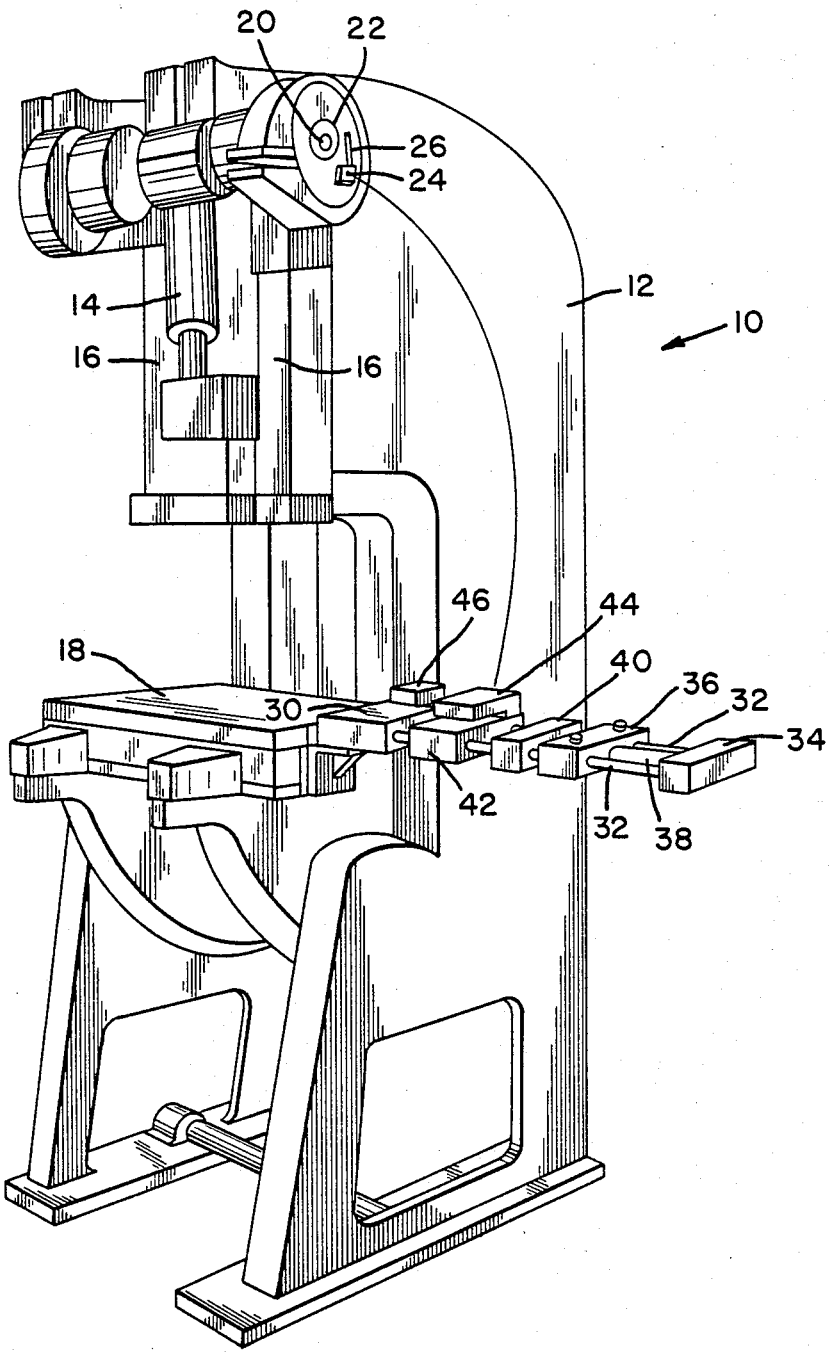
FIG. 1 is a perspective view showing a punch press that incorporates a feed apparatus in accordance with the present invention.

Referring now to the drawings, and particularly to FIG. 1, a punch press 10 is shown including a frame 12 on which is mounted a ram 14 that reciprocates vertically. Ram 14 is slidably supported in ways 16 carried by frame 12. A work table 18 is supported by frame 12 in underlying relationship with ram 14. Rotatably mounted at the top of frame 12 and above work table 18 is shaft 20 which carries at one end an eccentric timing cam 22. A limit switch 24 including an actuator arm 26 is mounted on frame 12 with the actuator arm 16 positioned to bear against and to be actuated by timing cam 22 to pivot arm 24 to open and close the switch contacts.

Positioned contiguous to and cantilevered from one side of work table 18 is a stock feeder 28, the purpose of which is to successively present work in the form of individual sheets or a continuous coil to the place on work table 18 where a desired forming or work operation is performed by tooling carried by ram 14. Stock feeder 28 includes a mounting block 30 secured to work table 18. Extending from mounting block 30 remote from work table 18 are a pair of guide rods 32. A rear stock support 34 is secured to the outer ends of guide rods 32. Carried on and fixed to guide rods 32 between mounting block 30 and rear stock support 34 are a rear feed bar 36 and a fine adjustment block 40. A feed block 42 is slidably carried on guide rods 32 for reciprocating movement between mounting block 30 and fine adjustment block 40. A feed cylinder 38, fixed at one end to rear stock support 34 and at the other end to feed bar 36, drives feed block 42 along guide rods 32. A feed clamp 44 is mounted on and supported by feed block 42 and serves to hold the work to feed block 42 during feeding. A hold clamp 46 is carried by mounting block 30 and serves to hold the work at the work station under ram 14 during the forming or working operation.

The structure of stock feeder 28 is shown in greater detail in the exploded view of FIG. 2. Mounting block 30 is secured to work table 18 with the upper surfaces of each substantially coplanar. Hold clamp 46, carried on mounting block 30, includes a mount 48, to which a bushing 50 is secured and slidably houses a hold gripper 52, which is connected to a piston 54 by means of a retaining screw 56. Piston 54 is slidably received in a cylinder (not shown) formed in the underside of cylinder cap 58, and a fluid connection (not shown) provides communication with a source of fluid under pressure. Gripper 52 is spring biased to a non-gripping position by means of a spring 60, which serves to urge piston 54 upwardly away from the upper surface of mounting block 30. A lower pad 62 is removably positioned in a recess in mounting block 30 to form the lower support surface for the work and to serve as a clamping surface against which hold gripper 52 operates.

Guide rods 32 extend from mounting block 30 to rear stock support 34 and are retained by means of screws 64 at both ends. Rear feed bar 36 is fixed on guide rods 32 and supports one end of feed cylinder 38, the other end of which is fixed to rear stock support 34. The piston rod 66 of feed cylinder 38 extends freely through opening 68 in rear feed bar 36. Rear stock support 34 includes a feed cylinder inlet port 70 for introducing pressurized air into feed cylinder 38 at the head end side of the feed cylinder piston, and rear feed bar 36 includes a similarly arranged feed cylinder inlet port (not shown) for introducing pressurized air into feed cylinder 38 at the rod end side of the feed cylinder piston.

Rear feed bar 36 also includes a T-slot 72 on its upper surface that extends transversely to guide rods 32. A laterally shiftable stock guide roller 74 is rotatably carried by retaining screw 78, which is received in T-slot 72 and secured in position by means of stock guide T-nut 76. Guide roller 74 can be fixed in a set position along T-slot 72 to serve as a guide for one edge of the work being fed. The other edge of the work bears on laterally fixed stock guide roller 80, rotatably carried by retaining screw 78.

Fine adjustment block 40 is adjustably fixed on guide rods 32 between rear feed bar 36 and mounting block 30, and together with mounting block 30 defines the limits of travel of feed block 42. Positioning of fine adjustment block 40 on guide rods 32 is accomplished by means of adjusting screw 82 which is threadedly adjustably received in rear feed bar 36. The end of screw 82 near block 40 is provided with a stop 83 which serves as a reference for block 40. A pair of locking screws 84 clamp fine adjustment block 40 to guide bars 32 when it is appropriately referenced. Fine adjustment block 40 also includes a bore 86 through which piston rod 66 freely passes to connect securely with feed block 42.

Feed block 42 is slidably carried on guide rods 32 by means of a pair of bearings 88 retained in bores 89 by retaining rings 90. A retaining screw 92 threadedly engages a threaded aperture in the end of piston rod 66 to fasten it to feed block 42.

Feed clamp 44 is carried on the upper surface of feed block 42 and includes a feed gripper mount 94 within which a bushing 96 is provided to slidably receive feed gripper 98. A piston 100 is fixed to gripper 98 by means of a retaining screw 102. Feed gripper piston 100 is slidably received in a cylinder (not shown) formed in the underside of cylinder cap 104 and is connected to a suitable source of pressurized air to permit actuation of the feed gripper. A spring 106 is provided to bias gripper 98 away from the top of feed block 42 and into a non-gripping position. A lower pad 99 is removably positioned in a recess in feed block 42 to form the lower support for the work and to serve as a clamping surface against which feed gripper 98 works.

An hydraulic shock absorber in the form of piston rod 108 serves to cushion the impact of block 42 with mounting block 30 and with final adjustment block 40 at the extreme ends of its path of travel. Piston rod 108 is slidably carried in a cylinder 112 formed in feed block 42 and is slidably retained therein by means of retaining rings 114, which bear against and retain bushings 111 and seals 113. A shoulder 116 is formed on piston rod 108 to define piston 110 which has an outer diameter that is approximately 0.040 inches less than that of cylinder 112 in order to permit controlled flow of hydraulic fluid between piston 110 and cylinder 112 and thereby allow inward movement of piston rod 108 into feed block 42 against the resistance imparted by the hydraulic fluid to thereby provide the desired cushioning effect. Filler plugs 118 are provided to permit the addition of hydraulic fluid as necessary to the interior of cylinder 112 on each side of piston 110. A stroke adjusting screw 120 is threadedly received on each end of piston rod 108 in order to faciliate external adjustment of the effective length of piston rod 108 and thereby permit the length of its stroke to be changed.

The operation of the feeding device shown in FIG. 2 is controlled by means of the pneumatic sequencing circuit illustrated in FIGS. *3a–3e*. Feed clamp 44 and hold clamp 46 are connected to a source 122 of pressurized fluid through a four way, solenoid operated, spring return directional control valve 124. Valve 124 is a sliding spool valve the spool of which is suitably positioned by means of a solenoid 126 at one end of the spool and a spring 128 at the other end. Source 122 of pressurized fluid is connected to valve 124 through conduits 130 and 132. Conduits 134 and 136 extend from valve 124 to feed clamp 44 and to hold clamp 46, respectively.

A second directional control valve 138 is provided, preferably in the form of a four way, pressure operated directional control valve, to control the flow of pressurized fluid to the head and rod ends of feed cylinder 38. Conduits 130 and 140 interconnect pressure source 122 with valve 138, and conduits 142 and 144 interconnect valve 138 with the head and rod ends, respectively, of feed cylinder 38.

Valve 138 includes a slidable spool, the position of which is controlled by pilot fluid pressure, which acts on the respective ends of the spool through pilot conduits 146 or 148, connected to conduits 134 and 136, respectively. Pilot conduits 146 and 148 have a smaller cross sectional area than that of conduits 134 and 136, or are provided with orifices (not shown) or other flow restriction devices, to limit the flow area thereof and thereby cause a pressure drop to occur in conduits 146 and 148 during flow therethrough. In one embodiment of the invention the pilot conduit inner diameter was 0.094 inches and the orifice diameter was 0.078 inches.

Figure 3A:
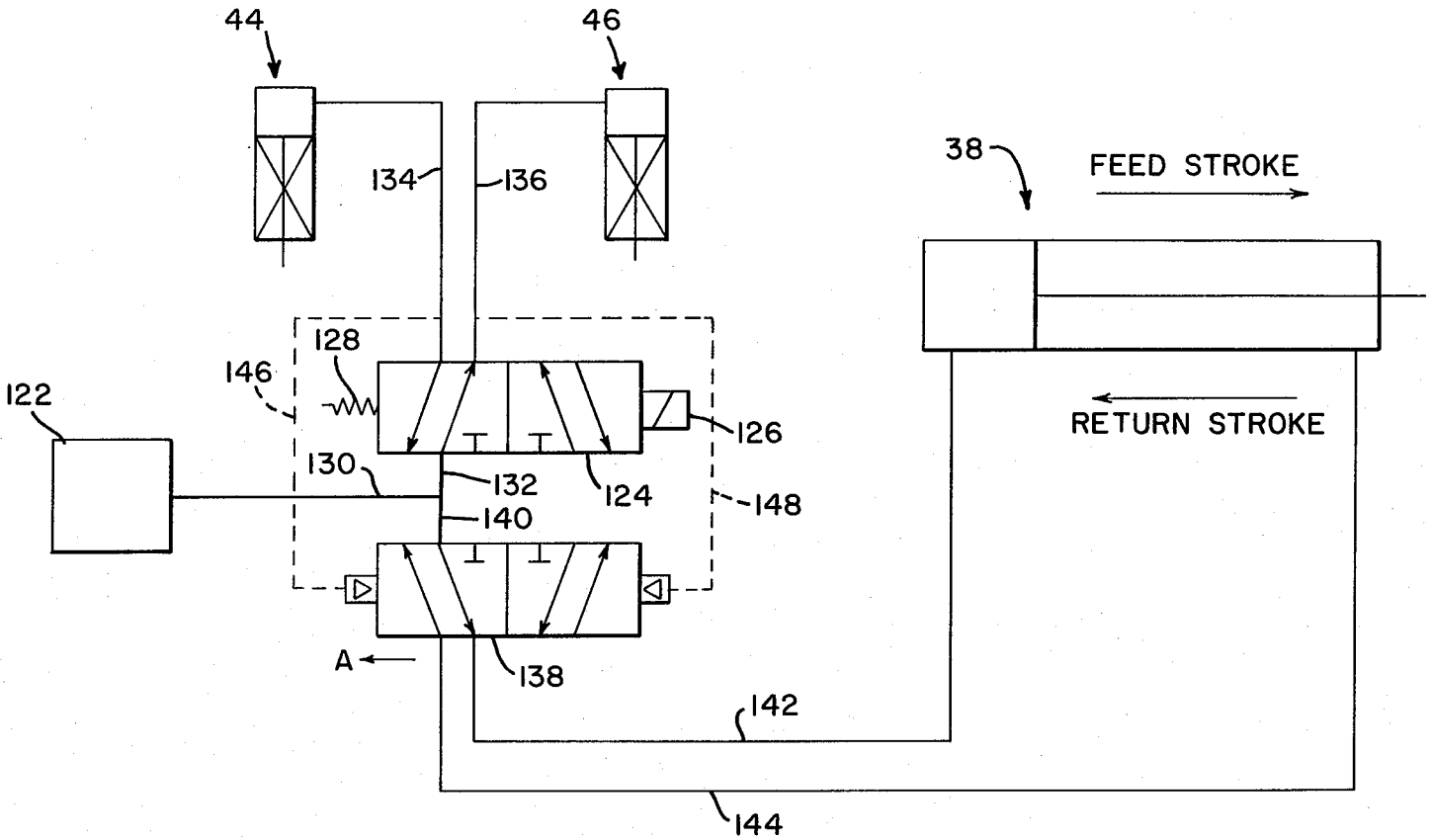
Figure 3B:
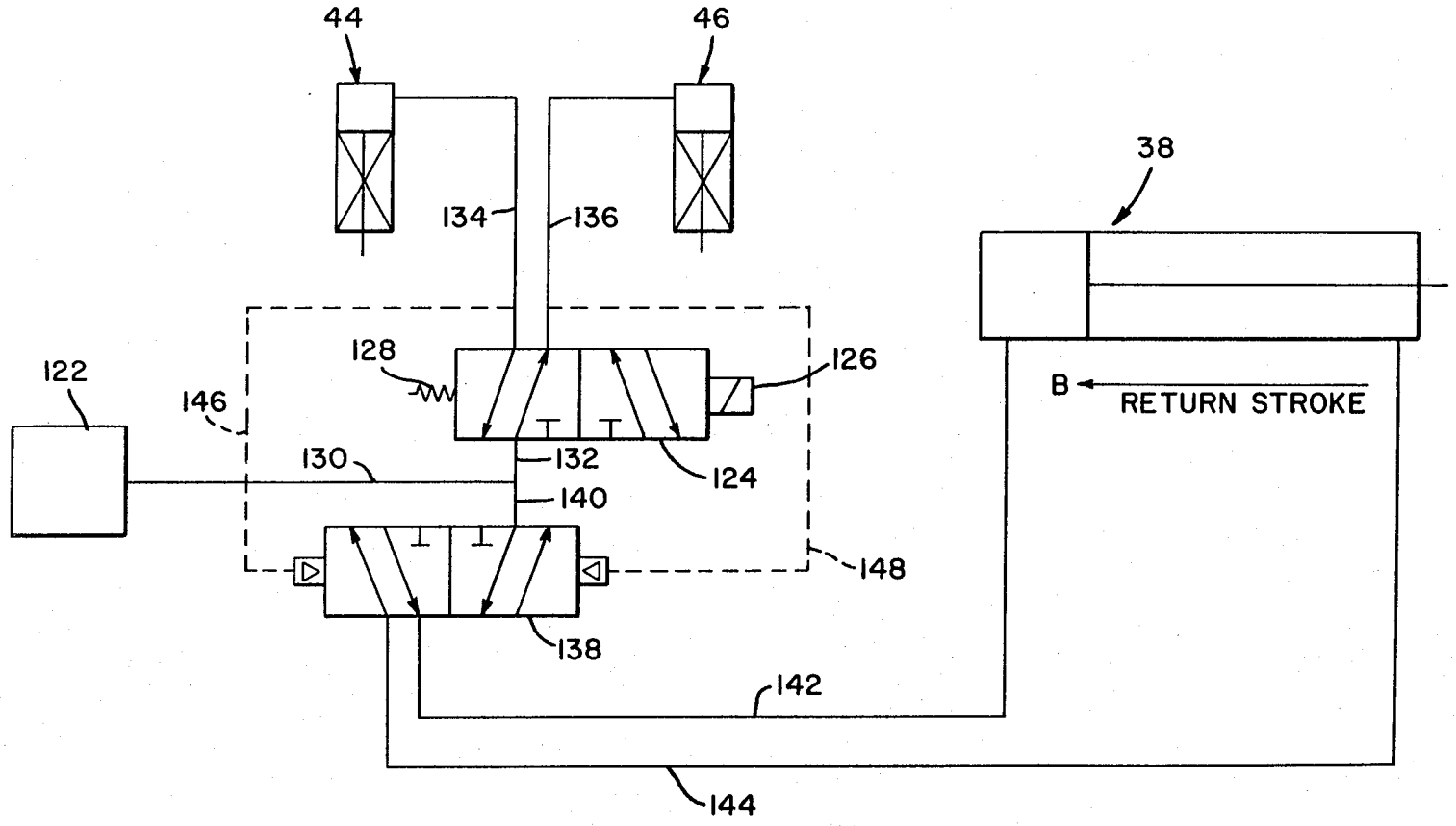

The operation of the circuit described is such that a predetermined, controlled sequence is established that enables the several operations during the feeding cycle to occur automatically and in a positive and rapid manner. Initially, and as seen in FIG. 3*a*, the machine is presumed to have been in the off condition and is turned on. Hold clamp 46 has been actuated by means of the pressurized fluid from source 122 having passed through conduits 130 and 132, through valve 124, into conduit 136 and hold clamp 46. Solenoid 126 is not energized at this time and therefore spring 128 has positioned the valve spool in valve 124 to permit the flow of pressurized working fluid to occur as described, while simultaneously venting feed clamp 44 to the atmosphere. At this time, the pressure in pilot conduit 146 is vented to atmospheric pressure via the valve 124 and that in pilot conduit 148 starts to build up from atmospheric pressure to that in conduit 136, which under steady state conditions would be substantially the pressure of source 122. Because of the flow restriction provided in conduit 148, this takes a predetermined time. When the pressure builds to a predetermined value, e.g., 40 psi, after a predetermined time correlated with the speed of rotation of timing cam 22, valve 138 is caused to move to the left in the direction of the arrow A shown in FIG. 3*a*. Valve 138 is shown in that position in FIG. 3*b*. Now there is communication between source 122 and the rod end of feed cylinder 38 through conduits 130, 140, and 144, through valve 138, and the piston and rod in feed cylinder 38 begin moving to the left (see arrow B) as shown in FIG. 3*b*, and start to execute a return stroke. Meanwhile clamping force is being exerted against the work by the hold clamp 46.

Figure 3C:
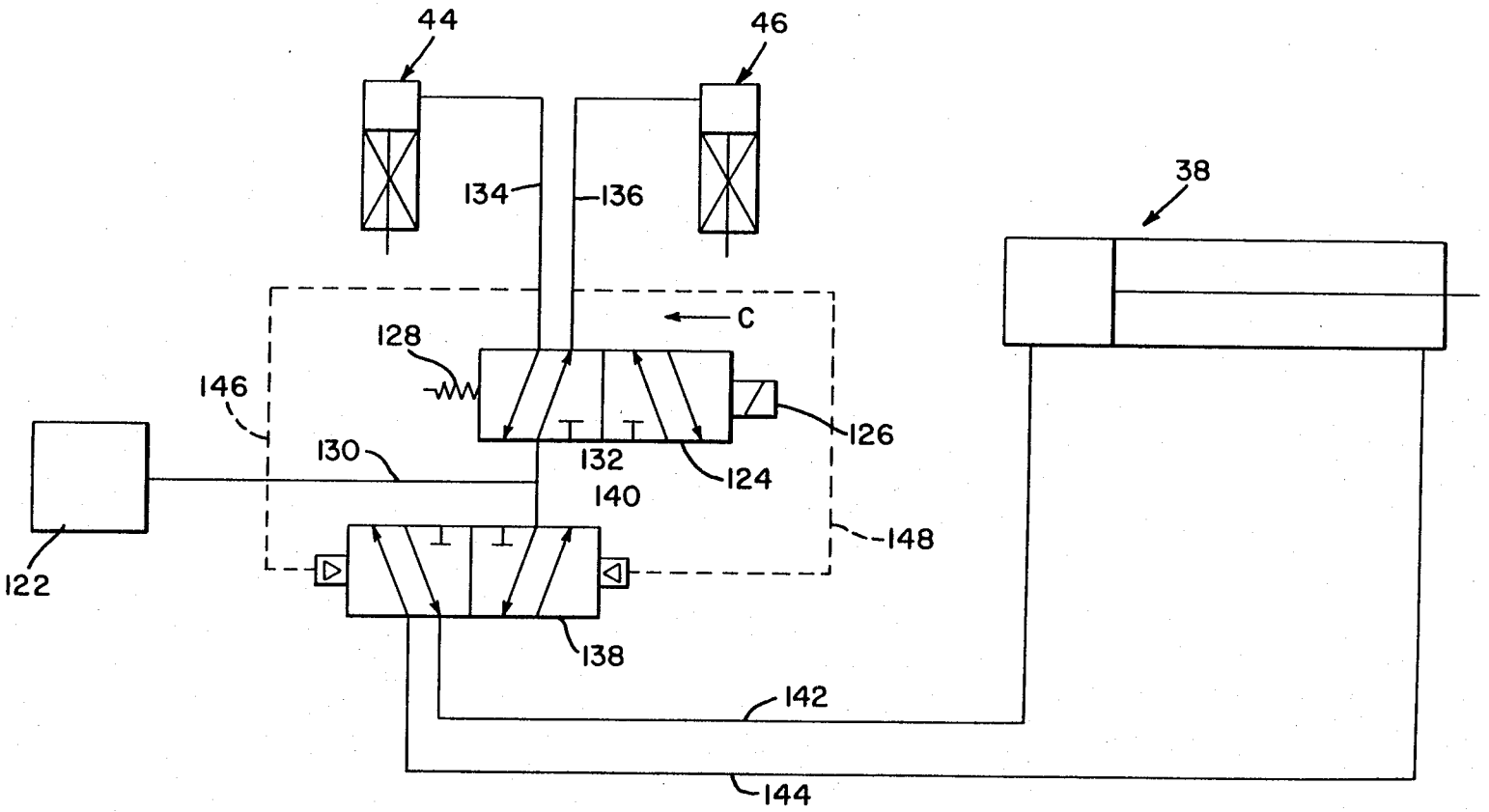
Figure 3D:
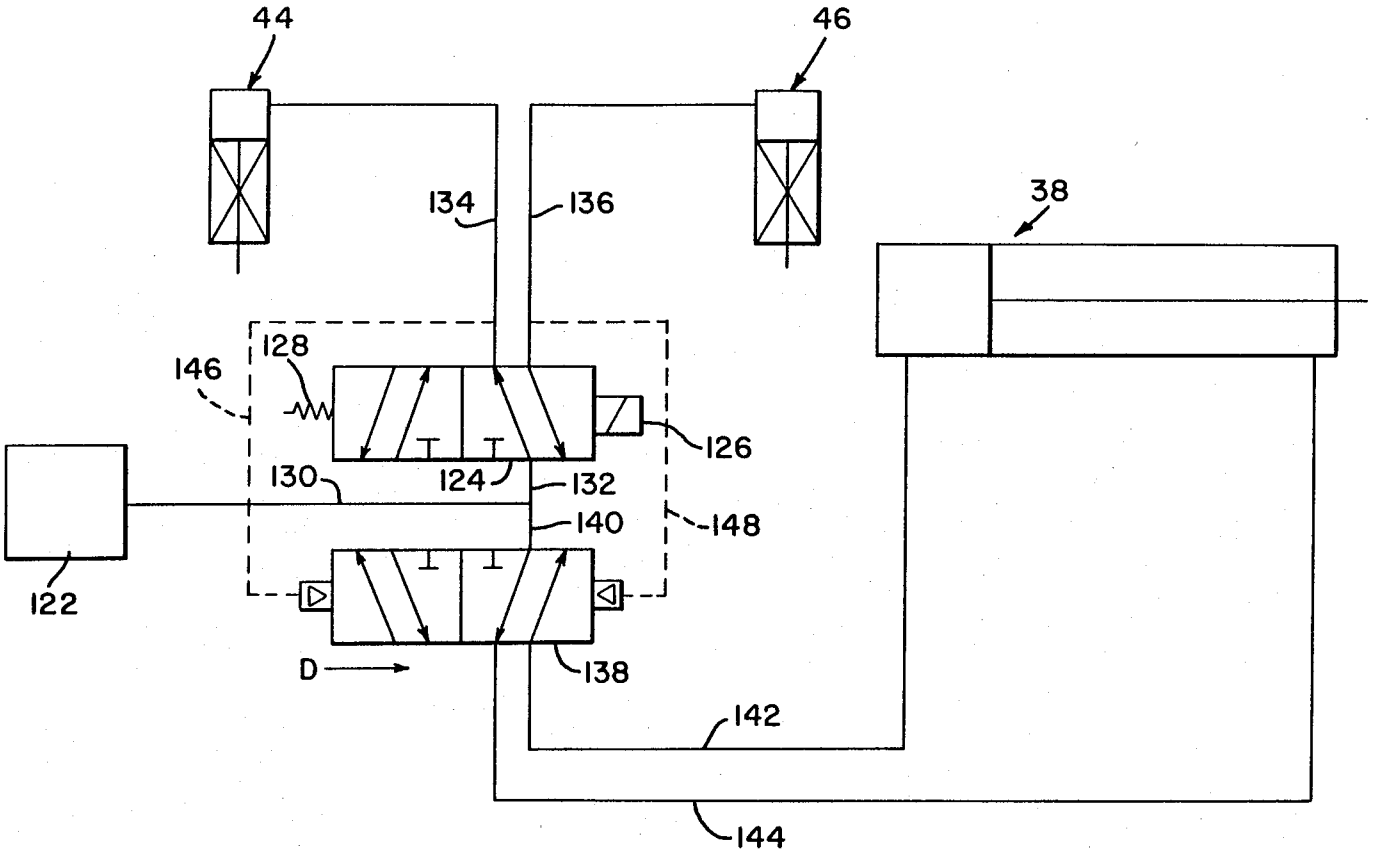

Shaft 20 rotates timing cam 22 to move contact arm 26, which closes the contacts of limit switch 24 to energize solenoid 126, which, in turn, causes the spool in valve 124 to move to the left, (see arrow C in FIG. 3*c*) against the force of spring 128, to the position shown in FIG. 3*d*. When that movement commences, the feed cylinder is ready to execute a feed stroke. When the movement is completed, hold clamp 46 is vented to the atmosphere and feed clamp 44 is connected to pressure source 122 through conduits 130, 132, and 134, through valve 124 to clamp the work to feed block 42 (see FIG. 2). The pressure in conduit 134 increases from atmospheric pressure to substantially that of source 122. Simultaneously, the pressure in pilot conduit 146 also begins to increase, but at a slower rate, to a predetermined value, e.g., 40 psi, because of the pressure drop caused by the flow restriction or orifice therein. Sufficient time elapses to allow feed clamp 44 to close and then the spool in valve 138 is caused to move to the right (see arrow D in FIG. 3*d*) to arrive at the position shown in FIG. 3*e*. The spool of valve 138 is arranged to shift sharply at a predetermined pressure differential developed across its ends.

Figure 3E:
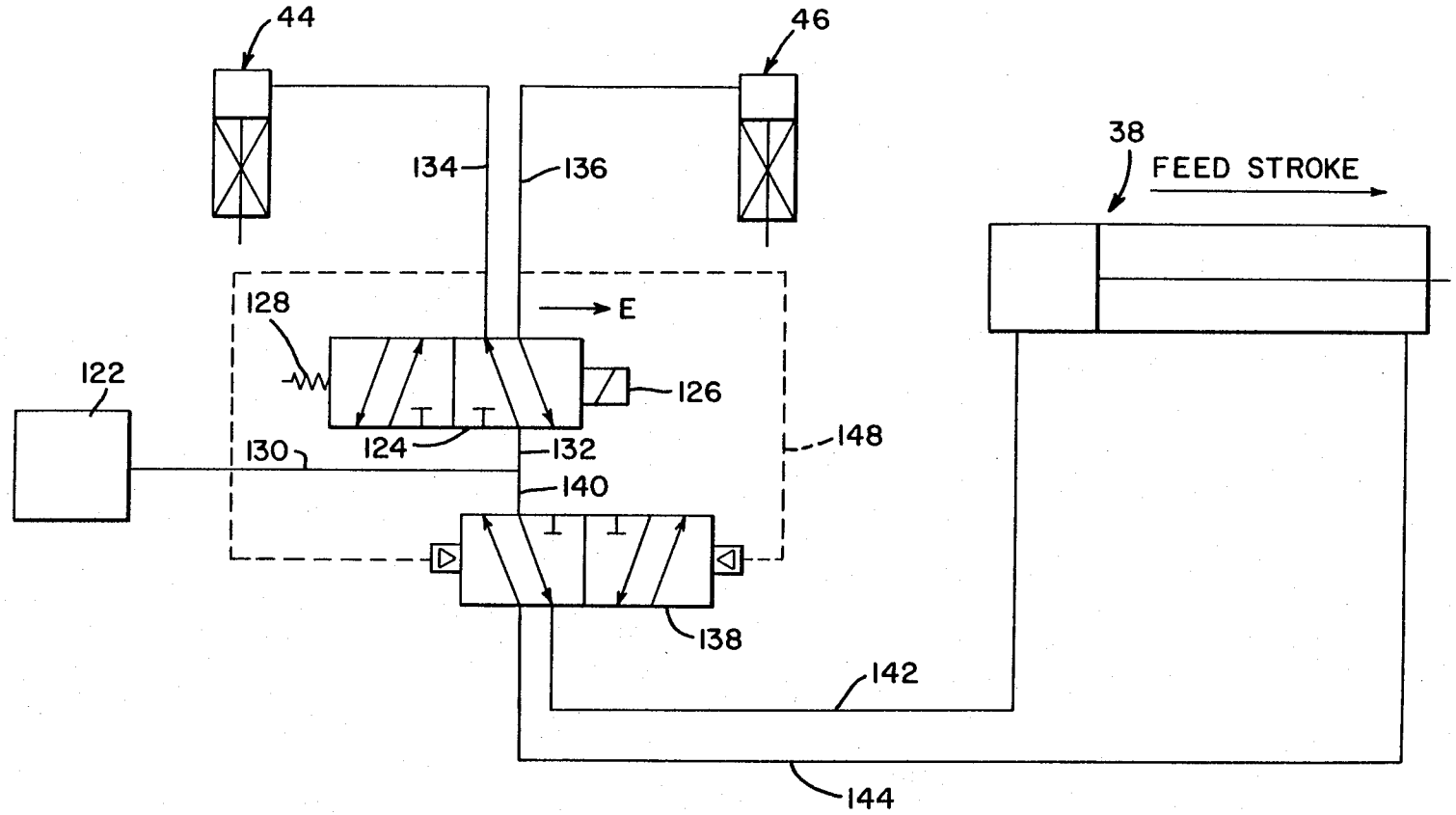

Upon the spool in valve 138 moving to the FIG. 3*e* position, the rod end of feed cylinder 38 is vented to the atmosphere through conduit 144 and the head end thereof is in communication with pressure source 122 through conduits 130, 140, and 142. As a result, the feed cylinder is caused to execute a feed stroke and to move feed block 42 (see FIGS. 1 and 2), and also the work now clamped thereto by means of feed clamp 44, toward work table 18.

Because the action of feed cylinder 38 and ram 14 are synchronized through the cam arrangement described, when the work is in proper position, the timing cam 22 has rotated to the point where the closing pressure on actuator arm 26 of limit switch 24 is released, thereby deenergizing solenoid 126, whereupon the spool in valve 124 is shifted to the right by spring 128, as shown by arrow E in FIG. 3*e*, causing feed clamp 44 to be vented to the atmosphere and the holding force on the work to be released. At the same time, hold clamp 46 is pressurized to hold the work to mounting block 30 immediately before, during, and immediately after the performance thereon by ram 14 of the particular work operation. The pressure in pilot conduit 146 falls to atmospheric pressure and that in pilot conduit 148 gradually builds up as a result of the pressure buildup in conduit 136, but at a slower rate because of the flow restriction in conduit 148, and the cycle is repeated.

The feeding device of FIG. 2 is shown in assembled form in FIG. 4 with the control valves and connecting lines in place. Feed cylinder control valve 138 is secured to rear feed bar 36 so that conduit 144, which is illustrated schematically in FIGS. 3*a*–3*e*, extends from valve 138, through rear feed bar 36, and communicates with the rod end of feed cylinder 38, which abuts bar 36, to provide direct connection therewith. Conduit 142 from valve 138 extends along guide rail 32 and provides communication between the head end of feed cylinder 38 through aperture 71 (see FIG. 2), which communicates with feed cylinder inlet port 70 through a conduit (not shown) which is internally disposed in rear stock support 34. Control valve 124 abuts and interconnects with valve 138, as will hereinafter be described, and receives pressurized fluid from supply 122 through conduit 130. Feed clamp conduit 134 and hold clamp conduit 136 extend from control valve 124 to feed clamp 44 and hold clamp 46, respectively. Also extending from control valve 124 are feed clamp exhaust conduit 135 and hold clamp exhaust conduit 137, each of which terminates at feed block 42 to provide cooling and lubricating air for bearing 88, as hereinafter explained.

The interconnection of the directional control valves is shown in general form in FIGS. 3 and 4 and in more detail in FIGS. 5, 6, 7, and 8. The valves are configured so that they can be positioned in abutting relationship with the respective interconnections for the pilot conduits that are aligned to thereby reduce the distance therebetween and consequently increase the speed of operation of valve 138 in response to the pressures in conduits 134 and 136. In FIG. 5 and 6, control valve 124 is shown with solenoid 126 in the deenergized state, in which return spring 128 urges valve spool 150 into the leftmost position as shown. When in that position, the pressurized air from the air supply source flows through conduit 130 into control valve 124. The air passes into and through passageway 151 around spool 150 and exits into hold clamp conduit 136 to hold clamp 46. A portion of the air enters passageway 158 in valve 124 and through passageway 160 in pilot operated control valve 138 to the left side of spool 156 to cause it to move in a rightward direction, and thereby admit pressurized air into feed cylinder 38 at the rod end side of the piston. In this position, the valve arrangement and flow paths are as shown in FIG. 3*b*. As previously pointed out, because the flow areas of passageways 158, 160 are smaller than that of hold clamp conduit 136, hold clamp 46 is actuated before the pressure acting against the left side of spool 156 builds up sufficiently to cause the spool to shift to the right.

When solenoid 126 has been energized, as shown in FIGS. 7 and 8, valve spool 150 shifts to the right, against the force of spring 128, providing communication between air supply conduit 130 and feed clamp conduit 134 by way of passageway 151 to cause feed clamp 44 to clamp the work. At the same time, passageway 158 is disconnected from air supply conduit 130 and passageway 152 is connected thereto so that pressurized air can flow therethrough into passageway 154 in control valve 138, to thereby cause spool 156 to move to the left and admit pressurized air to act against the head end of the piston in feed cylinder 38. The intersection of passageways 158 and 160 and of passageways 152 and 154 is defined by a recess 155 within which an O-ring 157 is positioned to prevent pilot air leakage at the interface of valves 124 and 138.

As shown in FIGS. 9 and 10, bearings 88 in feed block 42 are provided with cooling and lubricating air through radially directed apertures 162 which are supplied with exhaust air from feed clamp 44 and hold clamp 46 through conduits 135 and 137, respectively. The air thereby provided serves to cool the bearings and to provide a lubricating air film to reduce the friction between bearings 88 and guide rods 32, thereby permitting an increase in the speed of operation of the feeder of the present invention. As shown, the clamp exhaust air passes through passageways 164, which extend substantially the length of feed block 42 from inlet ports 166 to a pair of outlet ports 168. Passageways 164 intersect bores 170 in feed block 42, preferably at an enlarged concentric annular cavity 172, and thereby permit the pressurized air from the feed and hold clamps to flow around the outside of bearings 88 to cool them and also to flow into and through apertures 162 to the interior of the bearings to provide a lubricating air film between bearings 88 and guide rods 32.

When feed block 42 approaches the end of its feed stroke, shock absorber 108 serves to slow it down and to prevent it from impacting the front mounting block. At that point, the work is in position for the forming operation to be performed thereon, and the ram has moved downwardly causing the timing cam to reach a position wherein the limit switch is opened, thereby deenergizing the solenoid valve and causing the clamp cylinder valve to shift so that pressurized air is supplied to the hold clamp to hold the work firmly as the forming operation takes place. Immediately thereafter, the feed clamp cylinder is released from the work, and the feed cylinder valve shifts so that pressurized air operates against the rod end of the piston to cause the feed block to return to its initial position adjacent the fine adjustment block. As the feed block approaches the fine adjustment block the shock absorber again serves to cushion the feed block and prevent impact with the fine adjustment block. Thereupon the cycle is repeated successively.

While particular embodiments of the present invention have been illustrated and described, it will be apparent to those skilled in the art that various changes and modifications can be made without departing from the spirit and scope of the invention, and it is intended to cover in the appended claims all such changes and modifications that fall within the scope of the present invention.

What is claimed is:

1. Feed apparatus for successively presenting articles to a work station for the performance of an operation thereon by a tool, said apparatus comprising:

(a) feeding means for conveying an article;

(b) first holding means including a fluid operated first actuator movable from a clamping position to an unclamping position to selectively clamp the article to the feeding means while it is being conveyed thereby and to subsequently release the article therefrom;

(c) second holding means including a fluid operated second actuator movable from a clamping position to an unclamping position to selectively hold the article in position at the work station while the operation is being performed thereon and subsequently release the article therefrom;

(d) said feeding means and said first and second holding means operable by a pressurized fluid control circuit, said circuit including a first directional control valve operatively connected to each of said first and said second holding means by first and second main flow conduits, respectively, to alternately operate the same, and a second directional control valve to operate said feeding means, said second directional control valve interconnected with said first and second main flow conduits of said first directional control valve by first and second pilot conduits, respectively, each said pilot conduit having a smaller flow area than the flow area of the respective main flow conduit, said second directional control valve operable thereby to cause said feeding means to execute a feeding stroke and a return stroke only after one of said first and second holding means, has been made operable and the other is made inoperable.

2. The apparatus of claim 1 wherein said pilot conduits between said first and said second directional control valves each include a flow restriction orifice to define the smaller flow area.

3. The apparatus of claim 1 wherein said control circuit is a pneumatic circuit including a source of pressurized air connected to the inlet sides of each of said directional control valves.

4. The apparatus of claim 1 wherein said second flow control valve includes a shiftable valve spool to control the flow of fluid therethrough, said valve spool positionable by the pressures in said first and said second conduits.

5. The apparatus of claim 4 wherein said first and second flow control valves are in abutting relationship and the interconnection therebetween includes aligned intercommunicating passageways in each of said valves.

6. The apparatus of claim 1 wherein said first directional control valve includes a shiftable valve spool, the position of which is governed by the position of the tool relative to the work station.

7. The apparatus of claim 6 wherein said first directional control valve includes a spool position biasing means and a solenoid, said valve spool connected with and shiftable by said solenoid, and means for energizing said solenoid.

8. The apparatus of claim 7 wherein said energizing means includes a cam operatively associated with the tool, and a limit switch operable by said cam and connected with said solenoid.

9. The apparatus of claim 1 wherein said feeding means includes stationary guide means and an article support movable along said guide means, said article support including means to provide an air film between said support and said guide means to reduce the friction therebetween.

10. The apparatus of claim 1 wherein said feeding means includes shock absorber means to cushion impact forces at the end of the stroke thereof.

* * * * *